US010174628B2

(12) United States Patent
Humhauser et al.

(10) Patent No.: US 10,174,628 B2
(45) Date of Patent: Jan. 8, 2019

(54) AXIALLY DIVIDED INNER RING FOR A TURBOMACHINE AND GUIDE VANE RING

(71) Applicant: MTU Aero Engines AG, Munich (DE)

(72) Inventors: Werner Humhauser, Moosburg (DE); Josef Wagner, Erdweg (DE); Hermann Klingels, Dachau (DE)

(73) Assignee: MTU Aero Engines AG, Munich (DE)

( * ) Notice: Subject to any disclaimer, the term of this patent is extended or adjusted under 35 U.S.C. 154(b) by 324 days.

(21) Appl. No.: 15/017,729

(22) Filed: Feb. 8, 2016

(65) Prior Publication Data

US 2016/0237855 A1 Aug. 18, 2016

(30) Foreign Application Priority Data

Feb. 16, 2015 (EP) ..... 15155241

(51) Int. Cl.

| | |
|---|---|
| ***F01D 9/04*** | (2006.01) |
| ***F01D 17/16*** | (2006.01) |
| ***F04D 29/56*** | (2006.01) |
| ***F01D 11/00*** | (2006.01) |
| ***F01D 25/24*** | (2006.01) |

(Continued)

(52) U.S. Cl.

CPC ..... *F01D 9/042* (2013.01); *F01D 9/04* (2013.01); *F01D 11/001* (2013.01); *F01D 17/162* (2013.01); *F01D 25/246* (2013.01); *F04D 29/522* (2013.01); *F04D 29/542* (2013.01); *F04D 29/563* (2013.01); *F04D 29/644* (2013.01); *F05D 2220/32* (2013.01);

(Continued)

(58) Field of Classification Search

CPC ..... F01D 9/042; F01D 17/162; F04D 29/563; F05D 2260/30

See application file for complete search history.

(56) References Cited

U.S. PATENT DOCUMENTS 2,671,634 A * 3/1954 Morley ..... A01N 25/08 415/149.4

3,727,660 A 4/1973 Burge (Continued)

FOREIGN PATENT DOCUMENTS

EP 1757776 A2 2/2007

OTHER PUBLICATIONS

Kaltenhauser, D.; New Dimensions in the Screw Holder, 1022 Adhasion Kleben & Dichten, 37 (1993) No. 4, Munich Germany, pp. 39-40, XP000354466, ISSN: 0943-1454.

*Primary Examiner* — Ninh H. Nguyen

(74) *Attorney, Agent, or Firm* — Barlow, Josephs & Holmes, Ltd.

(57) ABSTRACT

An axially divided inner ring for a turbomachine, for fastening to guide vanes of the turbomachine. The inner ring comprises at least one first, solid ring segment disposed upstream, and a second, solid ring segment disposed downstream, wherein the first ring segment is joined to the second ring segment in a detachable manner by means of at least one fastening element. The first ring segment and/or the second ring segment is joined to at least one sealing segment. The inner ring comprises a securing element for securing the fastening element, wherein the securing element is joined to the first ring segment and/or to the second ring segment. In addition, the present invention relates to a guide vane ring of a turbomachine having guide vanes, which have an axially divided inner ring according to the invention.

12 Claims, 5 Drawing Sheets

(51) Int. Cl.
*F04D 29/52* (2006.01)
*F04D 29/54* (2006.01)
*F04D 29/64* (2006.01)

(52) U.S. Cl.
CPC .... *F05D 2240/11* (2013.01); *F05D 2240/128* (2013.01); *F05D 2260/30* (2013.01)

(56) References Cited

U.S. PATENT DOCUMENTS

| | | | | |
|---|---|---|---|---|
| 5,421,703 | A * | 6/1995 | Payling | F01D 9/042 415/209.3 |
| 7,458,771 | B2 * | 12/2008 | Abadie | F01D 9/042 415/160 |
| 8,206,094 | B2 * | 6/2012 | Seki | F01D 5/225 415/191 |
| 2007/0286719 | A1 | 12/2007 | Duesler et al. | |
| 2009/0208338 | A1 | 8/2009 | Major et al. | |
| 2010/0310358 | A1 | 12/2010 | Major et al. | |

* cited by examiner

AXIALLY DIVIDED INNER RING FOR A TURBOMACHINE AND GUIDE VANE RING

BACKGROUND OF THE INVENTION

The present invention relates to an axially divided inner ring for a turbomachine and a guide vane ring.

In turbomachines, in particular in axial gas turbines, guide wheels (in the following, the terms "guide wheel" and "guide vane ring" will be used synonymously) are often joined to inner rings at their radially inner end for stabilizing the guide vanes and for fastening of inlet seals. The inlet seals should at least reduce leakage flows between an inner-lying rotor and the guide vane ring. There are different embodiments for the inner rings. For example, there are multi-part inner rings, which can be divided both radially and axially, as well as in the peripheral direction. Axially divided inner ring segments are usually screwed together. In addition, radially divided inner ring segments having inlet seals (radially inside) can be pushed onto or plugged onto the axially screwed-together inner ring segments (radially outside). When the turbomachine is in operation, the screw connections of the axially divided inner ring segments are potential weak spots with respect to material overload, aging of material including fracture of material, inadequate assembly (e.g., excessive tightening torque in the case of screw connections), etc.

SUMMARY OF THE INVENTION

An object of the present invention is to propose an axially divided inner ring for turbomachines, which, on the one hand, prevents leakage flows between a rotor and a guide vane ring of the turbomachine, and, on the other hand, provides a safeguard in case of damage to fastening elements in or on the inner ring.

The object according to the invention is solved by an axially divided inner ring and a guide vane ring of the present invention.

Thus, according to the invention, an axially divided inner ring is proposed for a turbomachine for fastening to guide vanes of the turbomachine. The inner ring comprises at least a first, solid ring segment disposed upstream, and a second, solid ring segment disposed downstream. The first ring segment is joined to the second ring segment in a detachable manner by means of at least one fastening element.

According to the invention, the first and/or the second ring segment is connected to at least one sealing segment. In addition, the inner ring comprises a securing element for safeguarding the fastening element, wherein the securing element is connected to the first ring segment and/or to the second ring segment.

Advantageous enhancements of the present invention are each the subject of dependent claims and embodiments.

Exemplary embodiments according to the invention may have one or more of the features named in the following.

Gas turbines are described as turbomachines particularly in the following purely by way of example, but without wanting to limit turbomachines to gas turbines. The turbomachine can be an axial turbomachine, in particular. The gas turbine can be an axial gas turbine, particularly, for example, an aircraft gas turbine.

A solid ring segment according to the invention is, in particular, a ring segment that has no hollow space. A hollow ring segment would be, for example, a ring segment that has one or more cavities for reducing weight along with a structurally high rigidity of the component.

In specific embodiments according to the invention, the first ring segment and the second ring segment are disposed axially one behind the other with respect to the main through-flow direction of the turbomachine. Both ring segments may engage in one another in different ways. For example, the second ring segment can enclose the first ring segment, or vice versa, in a U-shaped manner, or the segments can be fitted in an L-shaped manner. The ring segments can be joined together in a wholly or partially form-fitting manner.

In specific embodiments according to the invention, the first ring segment and/or the second ring segment is (are) segmented in the peripheral direction. For example, the first ring segment and/or the second ring segment may comprise half rings in the peripheral direction, each with a 180-degree peripheral angle. The ring segments can likewise be divided into multiple segments, for example, into three segments, each with a 120-degree peripheral angle; into four segments, each with a 90-degree peripheral angle; and so forth. In addition, the ring segments can be divided into segments having different peripheral angles.

In several embodiments according to the invention, the fastening element joins the first ring segment to the second ring segment in a force fit. For example, the ring segments can have planar, curved, or profiled surfaces that are pressed together in a force fit by means of a fastening element.

In some embodiments according to the invention, the fastening element is a screw. Several screws can be disposed over the periphery of the first and/or the second ring segment. The screws can be countersunk screws or any other type of screws.

In some embodiments according to the invention, the screw is disposed or a plurality of screws are disposed in a thread insert for joining the first ring segment to the second ring segment, or vice versa. An inner thread for the screw connection can be produced by means of the thread insert by introducing a hollow cylinder ("insert") having an inner thread into the first ring segment or into the second ring segment. The thread insert can be a wire thread insert.

In specific embodiments according to the invention, the securing element is joined in form-fitting manner to the first ring segment and/or to the second ring segment. The securing element can be a pin or a locking wire that is introduced into a form-fitting holder on one or on both ring segments and is joined therewith. After this form-fit joining, the locking wire can be secured against an undesired loosening, for example, by bending parts of the locking wire.

In certain embodiments according to the invention, the securing element is segmented in the peripheral direction. A securing element segmented in the peripheral direction can be a ring segment. The ring segment can be joined in form-fitting manner and/or in force-fitting manner to one and/or both axially divided inner ring segments; in particular, it can again be joined detachably. The securing element formed as a segmented ring segment can be shaped as a segmented annular disk.

In several embodiments according to the invention, the securing element is disposed in radial grooves of the first ring segment or of the second ring segment. The securing element is, in particular, a segmented annular disk. The radial grooves can assure a guidance and/or a securing against falling out axially or loosening of the respective ring segment. The radial grooves in particular have U-shaped profiles in cross section.

In the case of a fastening element configured as a screw, the securing element can be disposed on the front side relative to the head of the screw.

In specific embodiments according to the invention, the securing element is disposed separately from the fastening element. A separate arrangement can be an arrangement separating the two from one another. A separate arrangement can mean that the securing element has no direct contact with the fastening element. The securing element is neither joined in form-fitting manner nor in force-fitting manner to the fastening element.

In certain embodiments according to the invention, the inner ring has precisely one securing element per fastening element. For example, as a fastening element, each screw can be secured by a locking wire. The locking wire can be joined in form-fitting manner by means of one or more holders to at least one axially divided inner ring segment.

Some or all embodiments according to the invention may have one, several, or all of the advantages named above and/or in the following.

By means of the axially divided inner ring according to the invention, small screws can be used advantageously as fastening elements in the design and construction of small turbomachines. For example, in the case of small compressor dimensions, correspondingly small screw diameters can be used, since in the case of possible damage, e.g., if a screw head is torn off, there is no danger, or only a slight danger that broken pieces of screws will enter into the main flow duct or into another gas duct.

The axially divided inner ring according to the invention makes possible the containment or the encapsulation of screw pieces in the case of damage, for example, in the case of material fatigue of the screw or due to excessive tightening torque when mounting the screw. In addition, an axially divided inner ring can keep small, in a relatively constant manner, the sealing gap between an inlet seal (stator) and a sealing fin (rotor), in comparison to a sealing gap at a radially divided inner ring. A radially divided inner ring usually has clearances and larger sealing gaps due to its construction.

By means of the axially divided inner ring according to the invention, the number of parts of the inner ring and thus the weight of the inner ring and the costs thereof can be reduced advantageously. In addition, the structural space necessary for the axially divided inner ring according to the invention can be reduced in comparison to inner rings having radial inner ring segments.

Inlet seals can be fixed in place on the axially divided inner ring according to the invention without using additional, particularly radial, inner ring segments. Advantageously, an expensive additional radial sealing support can be dispensed with.

BRIEF DESCRIPTION OF THE DRAWING FIGURES

The present invention will be explained in the following by an example, based on the appended drawings, in which identical reference symbols designate identical or similar components: In the schematically simplified figures.

DESCRIPTION OF THE INVENTION

Figure 1:
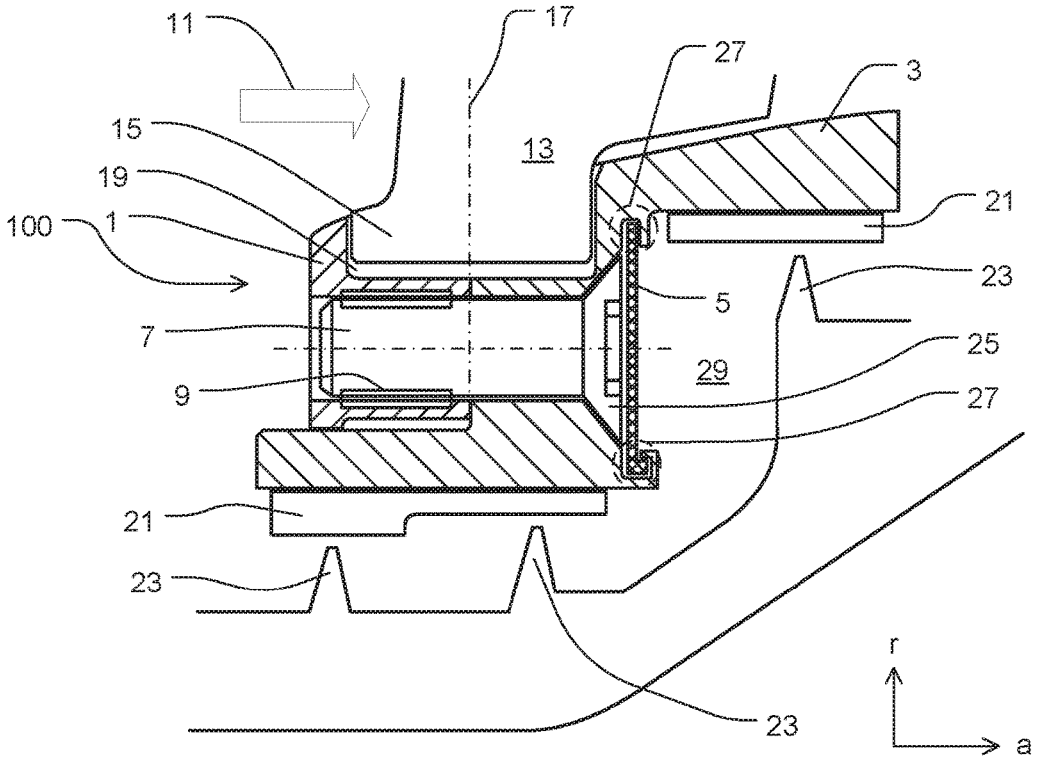
FIG. 1 shows a sectional view of an axially divided inner ring according to the invention having a ring segment as a securing element.

FIG. 1 shows a sectional view of an axially divided inner ring 100 according to the invention. For better clarity, the following are shown with hatch marks: a first, solid inner ring segment 1 disposed upstream; a second, solid inner ring segment 3 disposed downstream; and a securing element formed as an inner ring segment 5 in this embodiment.

The first ring segment 1 and the second ring segment 3 are joined together and fixed in place in a force-fit manner with a screw 7 as a fastening element. The screw 7 is screwed into a thread insert 9, which is fixed in place in the first ring segment 1. Such thread inserts 9 are often used for highly loaded connections, when, for example, the material into which the thread insert 9 is inserted does not have sufficient strength for a screw connection. The thread insert 9 is, in particular, a wire thread insert.

The screw 7 is shown as a countersunk screw by way of example. Other types of screws having other screw heads may also be used according to the invention.

The inner ring 100 according to the invention is joined to adjustable guide vanes 13 at the radial inner end, referred to the radial direction r perpendicular to the axial direction a (which is simultaneously the main through-flow direction 11 of the turbomachine). An overhang 15 of the guide vane 13 is mounted in a depression 19 about an axis of rotation 17.

At the radial inner end of the inner ring 100 are disposed inlet seals 21 (for example, honeycomb seals). When the turbomachine is installed, a sealing gap is formed due to the fact that a gap is formed between the static inlet seals 21 on the inner ring 100, on the one hand, and so-named sealing fins 23 on rotating sealing tips on the rotor shaft of the turbomachine, on the other hand, due to the rubbing of the sealing fins 23 on the inlet seals 21. This gap sealing should minimize the flow losses between the inlet seals 21 and the sealing fins 23 of the rotor shaft during the operation of the turbomachine.

The ring segment 5 formed as a securing element is disposed on the front side opposite the screw head 25. The ring segment 5 is guided into radial grooves 27. If, for example, the screw 7 detaches from the thread insert 9 unexpectedly or the screw 7 breaks in case of damage (for example, by excessive tightening torque when the screw 7 is mounted), the ring segment 5 can advantageously prevent the screw 7 or pieces thereof to move into the space 29 between the inner ring 100 and the rotor of the turbomachine or, in fact, to move into the main flow duct and be able to cause a great deal of damage therein (secondary damage), for example, on the rotor blades. This danger is greater, the smaller the inner rings 100 are, and thus also the smaller the screws 7 are dimensioned.

Figure 2:
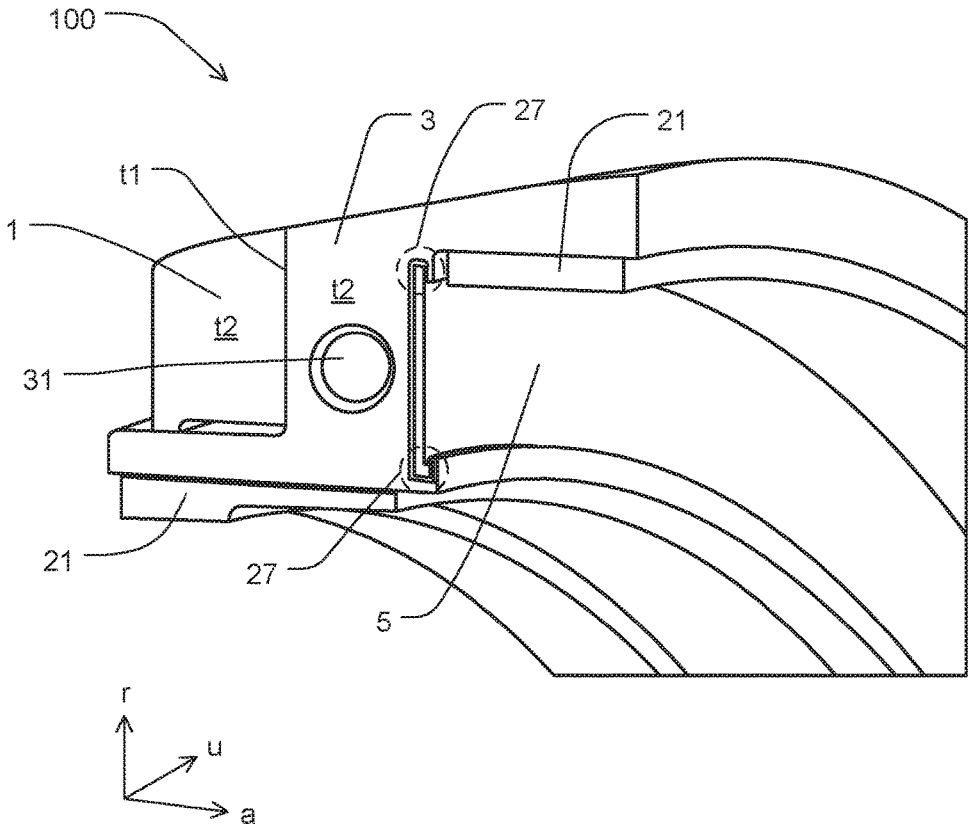
FIG. 2 shows a perspective view of an inner ring according to the invention having a ring segment as a securing element.

FIG. 2 shows a perspective view of an axially divided inner ring 100 according to the invention having the ring segment 5 as a securing element, with the first inner ring segment 1, the second inner ring segment 3, and the inlet seals 21. The ring segment 5 is guided into radial grooves 27.

The inner ring 100 divided in the axial direction a (division plane t1) is also divided or segmented in the peripheral direction u (division plane t2; plane of the drawing). In this exemplary embodiment, a segmented inner ring 100 means that the individual segments of the inner ring 100, thus the first ring segment 1, the second ring segment 3, the ring segment 5, and the inlet seals 21 are segmented. The segments are brought together and joined in the division plane t2 by means of trunnions (not shown in FIG. 2), which are introduced or inserted into bushes 31 (or boreholes).

The inner ring 100 can be subdivided, for example, into two segments, each with a 180° (degree) peripheral angle; into three segments, each with a 120° (degree) peripheral angle; into four segments, each with a 90° (degree) peripheral angle; or into other segmentations.

Figure 3:
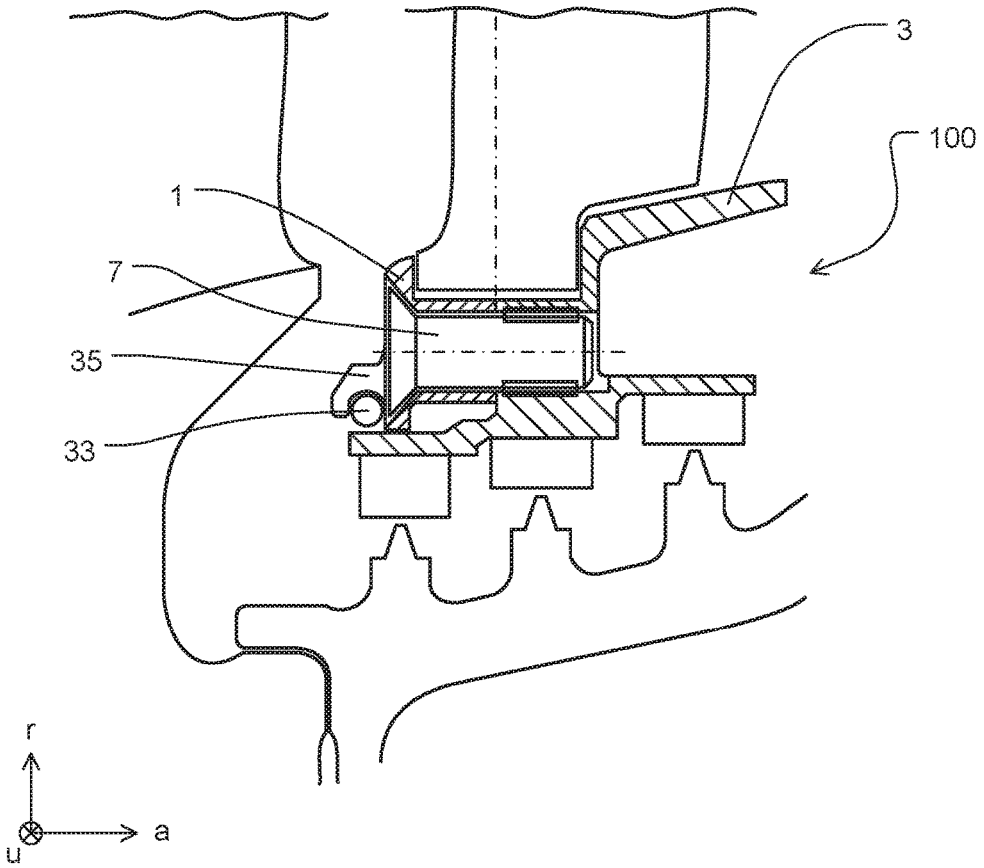
FIG. 3 shows a sectional view of an inner ring according to the invention having a locking wire as a securing element.

FIG. 3 shows a sectional view of an axially divided inner ring 100 according to the invention with a locking wire 33 as a securing element. The locking wire 33 is fixed in place by means of holders 35 or joined in form-fitting manner with the first inner ring segment 1. The locking wire 33 secures the screw 7 (as a fastening element for joining the first inner ring segment 1 to the second inner ring segment 3) against an unintentional loosening, or, if the screw 7 breaks, for fixing in place pieces of the screw, and thus prevents greater damage to the turbomachine.

Figure 4:
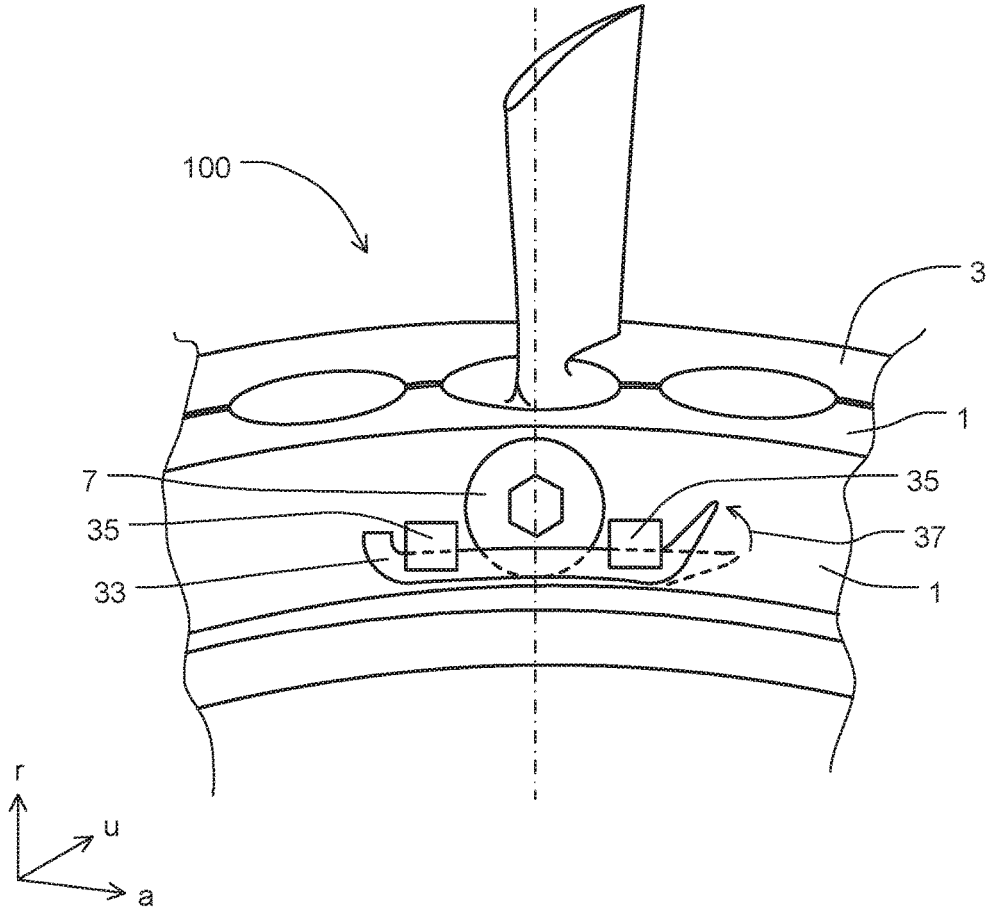
FIG. 4 shows a perspective view of an inner ring according to the invention having a locking wire as a securing element.

FIG. 4 shows a perspective view of an inner ring 100 according to the invention having a locking wire 33 as a securing element for the screw 7. In the installed state, the locking wire 33 is first moved under the holders 35 and secures the screw 7 against loosening. Subsequently, the locking wire 33 itself is secured against loosening or being pulled out by bending the tip of the locking wire 33 (indicated by the arrow 37 in FIG. 4).

The holders 35 can be joined to the first inner ring segment 1, for example, by means of soldering, welding, adhesive bonding, or by employing another method. Likewise, the holders 35 can be produced by means of an additive method during the manufacture of the inner ring segment 1.

Figure 5:
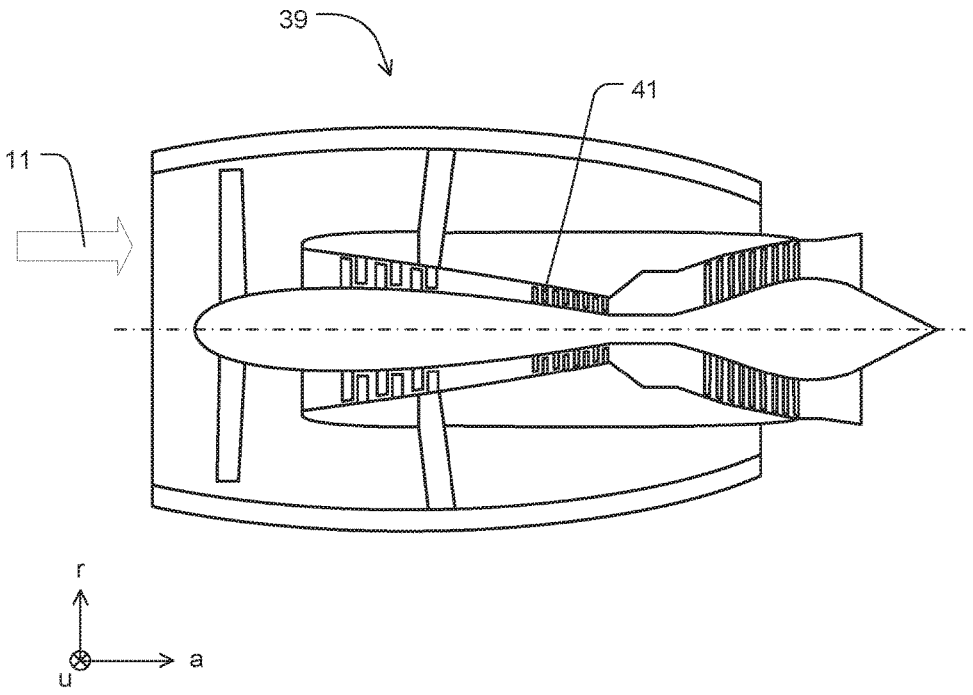
FIG. 5 shows a gas turbine having a guide vane ring according to the invention in a schematically greatly simplified manner.

FIG. 5 shows schematically, in a very simplified manner, a gas turbine 39, into which a guide vane ring 41 according to the invention can be mounted.

What is claimed is:

1. An axially divided inner ring for a turbomachine for fastening to guide vanes of the turbomachine, the axially divided inner ring comprises at least one first ring segment disposed upstream and one second ring segment disposed downstream, and the first ring segment is axially joined to the second ring segment in a detachable manner by at least one fastening element, wherein the first ring segment and/or the second ring segment is connected to at least one sealing segment, and the inner ring comprises a securing element for securing the fastening element, wherein the securing element is connected to and disposed between two opposing surfaces of the first ring segment and/or connected to and disposed between two opposing surfaces of the second ring segment.

2. The inner ring according to claim 1, wherein the fastening element joins the first ring segment to the second ring segment in a force-fit manner.

3. The inner ring according to claim 1, wherein the fastening element is a screw.

4. The inner ring according to claim 3, wherein the screw is disposed in a thread insert configured and arranged to join the first ring segment to the second ring segment or join the second ring segment to the first ring segment.

5. The inner ring according to claim 4, wherein the securing element is disposed on a front side in the region of the screw head.

6. The inner ring according to claim 1, wherein the securing element is joined to the first ring segment and/or to the second ring segment in a form-fit manner.

7. The inner ring according to claim 1, wherein the securing element is segmented in the peripheral direction.

8. The inner ring according to claim 1, wherein the securing element is disposed in radial grooves of the first ring segment or of the second ring segment.

9. The inner ring according to claim 1, wherein the securing element is retained separately from the fastening element.

10. The inner ring according to claim 1, wherein the inner ring has a securing element for each fastening element.

11. The inner ring according to claim 1, wherein the inner ring is configured in a guide vane ring of a turbomachine.

12. The inner ring according to claim 11, wherein the guide vane ring is joined to a housing of an axial high-pressure compressor.

* * * * *